US005979172A

United States Patent [19]

Teller

[11] Patent Number: 5,979,172

[45] Date of Patent: Nov. 9, 1999

[54] NON-DRIP HIGH EFFICIENCY AC SYSTEM UTILIZING CONDENSATE WATER FOR SUBCOOLING

[76] Inventor: Kevin Teller, 330 William St., Port Chester, N.Y. 10573

[21] Appl. No.: 09/110,213

[22] Filed: Jul. 6, 1998

[51] Int. Cl.[6] ..... F28D 5/00

[52] U.S. Cl. ..... 62/305; 62/277; 62/285

[58] Field of Search ..... 62/277, 279, 280, 62/305, 285

[56] References Cited

U.S. PATENT DOCUMENTS

| | | | |
|---|---|---|---|
| 5,113,668 | 5/1992 | Wache et al. | 62/305 |
| 5,211,027 | 5/1993 | Lofting et al. | 62/244 |
| 5,275,008 | 1/1994 | Song et al. | 62/81 |
| 5,419,147 | 5/1995 | Cooper | 62/171 |
| 5,682,757 | 11/1997 | Peterson | 62/259.2 |
| 5,692,384 | 12/1997 | Layton | 62/91 |

*Primary Examiner*—Henry Bennett
*Assistant Examiner*—Melvin Jones
*Attorney, Agent, or Firm*—Serle Ian Mosoff

[57] ABSTRACT

Disclosed is a high efficiency whole house or room air conditioner having an auxiliary heat exchanger in the liquid line between the condenser and the expansion device where the coolant fluid utilized in the auxiliary heat exchanger is condensate water produced by the evaporator. Also disclosed is a substantially dripless window or wall mounted air conditioner having an auxiliary heat exchanger in the hot gas line between the compressor and the condenser where the coolant fluid utilized in the auxiliary heat exchanger is condensate water and the condensate water coolant fluid is converted to a substantial extent to the gaseous phase by heat exchange with the hot gas line from the compressor.

3 Claims, 2 Drawing Sheets

NON-DRIP HIGH EFFICIENCY AC SYSTEM UTILIZING CONDENSATE WATER FOR SUBCOOLING

BACKGROUND

In a modern air conditioning system a heat exchange fluid, typically a form of Freon in a home or small commercial system, circulates in a closed system comprising a compressor, a first heat exchanger [condenser], a flow restriction and second heat exchanger called an evaporator. The heat exchange medium is compressed in the compressor and exits in the vapor phase at high temperature [from heat of compression] and high pressure. This returning gas flows to the outdoor heat exchanger or condenser, a series of coils containing the Freon or other heat exchange medium where air from outside the area to be cooled flows across the hot gaseous fluid containing coils and extracts heat from the fluid causing the fluid to condense to the liquid phase as it progresses through the coil, becoming totally fluid before the end of the coil. The reminder of the coil is used to subtract additional heat from the Freon before it leaves the condenser via the liquid line.

The fluid, now at ambient temperature in liquid phase and still at high pressure, enters the flow restriction. It expands as it exits the flow restriction. As a result of expansion and vaporization, the fluid exits as a mixed liquid/vapor at low temperature and pressure.

The fluid then enters the evaporator, a series of coils where a fan causes the hot air to be cooled to flow over the coils thereby transferring heat from the hot air to the fluid and changing it to the vapor phase as it warms. The low pressure fluid travels to the compressor where the compressor pumps the returning fluid to the condenser, where outside air is drawn across it by a fan as the cycle begins again.

In a central air conditioning system, the air contained in the space to be cooled is moved through a return air duct by a fan located in the air handling unit and then through a evaporator where the air is both cooled and dehumidified. The conditioned air is then distributed through the supply ductwork back to the space and the cycle repeats itself until the desired conditions are obtained. In a room air conditioner the air flowing across the evaporator is discharged directly into the room.

Various types of coolant fluids are in use to cool the air, such as Freon, water, or a water-gylcol mix.

As the hot room air passes over the evaporator coils and is cooled it is no longer able to hold the quantity of moisture present as water vapor. Droplets of liquid water condense on the surface of the evaporator coils. This condensate water, typically at a temperature of about 40° F., falls from the coils by gravity and is collected, typically in a drip pan. The condensate must be disposed of either by channeling it to a remote drain [in a central air conditioning installation] or by letting it drip from the unit in the case of a window or wall or transom mounted unit.

A common occurrence and nuisance in external wall and window AC units is the condensate water dripping from the unit. The condensate water, formed when hot air is blown across the cooling coils of the AC unit, becomes supersaturated and gives up its excess water as it cools, is usually directed to a drain pan. An overflow from the drain pan exits the unit by gravity and drips onto the ground.

Problems exist with the disposal of this condensate from window, wall or transom mounted units. In apartment buildings the wall units are typically arranged directly beneath each other and the water dripping from a higher unit oftentimes drips onto the lower unit causing an annoying sound offensive to the resident of the lower apartment as well as causing rust or degradation of the case of the lower unit. If the unit is transom mounted, which is often the only area the unit can be positioned in storefront installations, the unit will drip on customers entering or exiting the establishment. Draining the liquid away from the unit is not possible because of lack of drain locations.

The oil or gas shortage of 1974 started the process of increasing air conditioner efficiency. Even so, until about 1980 there was no particular concern about the cost of running an air conditioner as prices in general were fairly low. Air conditioners then began to be designed with efficiency considerations in mind, using fewer or lighter materials, in an attempt to obtain more BTU's/unit of electricity. Electric motors and compressors became smaller and lighter and drew less amperage, becoming more efficient due to advances in electrical engineering. An orifice, an advanced metering device, was designed which would allow a lower head pressure or condensing pressure to be used, which in turn lowered the electric draw the compressor used. In conjunction with this, more coil surface is now used in the condenser to lower head pressure and provide more subcooling of the liquid Freon.

Over the years different various more effective heat transfer fluids were developed. Time delay relays were also developed which delay the evaporator fan [inside fan] from turning on until the compressor runs for about 30 to 60 seconds to start the Freon moving through the inside coil, and which extend fan operation on shutdown for approximately 30 to 60 seconds to take advantage of the Freon still evaporating.

In window units, slingers are in use which throw condensate water onto the condenser coil to help transfer heat in conjunction with the outside air blown across the coil by the fan. This technique helps increase efficiency but not enough of the water hits the hot gas line to evaporate sufficient amounts of the condensate water to eliminate condensate disposal problems. The unevaporated water drains down the coil picking up heat and is warm when it reaches the drain pan from which the slinger draws water. Over a short period of time the water in the pan is warmed so that the efficiency of heat transfer decreases substantially. This results in the liquid line temperature approximating that of the environment, even though the slinger does a good job of cooling the condenser coil.

Attempts have been made to increase efficiency by running the liquid line [usually approximately 2 feet of plain copper tube] through the condensate water drain pan but this provides little benefit because the water is warm. Even were the water cool, the plain copper tube doesn't act as an effective heat exchanger. A copper tube run through the drain pan in a central unit doesn't work for the same reason.

Water cooled condensers were developed early on and are in use in commercial applications using cooling towers, but the residential use of water cooled condensers has never been feasible because of cost or esthetic considerations preventing the use of a residential cooling tower.

Among the improvements that have been implemented is the addition to the system of a small heat exchanger which coils the liquid line around the suction line, subcooling the liquid line while also boiling off any droplets of Freon still remaining in the suction line. This however does not increase the efficiency of the unit as energy is just transferred from one line to the other and was used mainly to protect the compressor from unevaporated droplets of Freon, or in some cases to cool the liquid line.

In summary, AC units have been lightened and made smaller, Freon 22 adopted as the Freon of choice in air conditioning systems [residential—and many commercial installations except for very large units], time delay relays are commonly used on evaporator fans, and lower head pressures are now the norm.

It is an object of this invention to further increase the efficiency of current air conditioning units.

It is a further object of this invention to remove the problems associated with the disposal of condensate water from window air conditioning units and other non-central air conditioning units.

SUMMARY OF THE INVENTION

I have now discovered a novel technique for utilizing waste condensate water from stationary and non-stationary, central and room, air conditioning systems to increase the efficiency of the system by subcooling the heat exchange fluid in the system utilizing the cooling capacity of condensate water produced by the air conditioning unit. In window or wall units, my novel technique can also be used to diminish or eliminate the volume of condensate water and thereby diminish or eliminate the need to dispose of condensate water.

My technique for increasing the efficiency of air conditioning systems utilizes the cooling values of condensate water by heat exchanging the cold condensate water with the heat exchange medium utilized in an air conditioning system. An auxiliary heat exchanger is inserted in the liquid line of the system. Condensate water collected from the evaporator is heat exchanged with the heat exchange liquid in the liquid line, cooling the heat exchange liquid before it enters the system's expansion device.

With ever increasing energy costs it is desirable to increase the efficiency of air conditioning units by not wasting any of the possible sources of cooling. Condensate water, is a currently wasted source of cooling in residential and mobile environments. Cold condensate water [45°–55° F.] may be used to take advantage of a free cooling effect it can offer which in turn yields a more efficient system.

The condensate can be put to use in various ways to provide a means of extracting heat from the Freon or other heat exchange fluid in the condensing unit instead of being wasted, providing a higher efficiency rating of the system. This can be of greatest benefit in hot humid areas where large amounts of condensate are produced, or where unconditioned outside air is constantly being introduced to the system, such as in a bus or other mass transportation system.

The more the Freon is subcooled the more heat it can extract once it is in the evaporator coil. Outside air temperature is the lowest temperature it can be subcooled to so as outside air temperature rises, so also does the liquid line temperature; and a corresponding drop in efficiency results. A mist of cold water sprayed on the condenser increases the efficiency of the unit by extracting more heat from the Freon, subcooling the liquid below air temperature, allowing the colder Freon to pick up more heat from the inside coil. Unfortunately water costs are too high for use of introduced coolant water to be economically feasible. However, condensate water can take the place of applied cooling water, is a free source of subcooling and is always wasted.

The optimum location for subcooling the liquid line in a central air conditioning unit is just before it enters the inside unit [evaporative coil], as it can pick up heat on its journey from the outside unit [usually through a hot attic] while the water is at its coldest as it drips from the condenser coil into the drain pan, before it picks up heat on its way outside.

In commercial applications there are usually long distances involved between drain lines and condensing units lessening the feasibility of the technique. However, depending of the siting of the various components, the technique can work in commercial applications, especially in rooftop package units and other forms of air conditioning for mobile uses, especially in mass transportation.

On a commercial unit, utilizing a water cooled cooling tower, the cooling water temperature is usually as low as the surrounding ambient temperature so subcooling is possible there also. Condensate from commercial units can be pumped back into the cooling tower and can provide make up water free of charge, provided algae growth is retarded.

In addition to its use for subcooling the Freon, condensate water can continue to the outside unit where it can be put to use.

An auxiliary heat exchanger can be used on the hot gas line. This has the effect of a small water cooled condenser partially condensing the Freon before it enters the condensing coil which in turn permits the existing condenser to provide more subcooling as the Freon becomes totally liquid at a point closer to the entrance of the coil.

An auxiliary heat exchanger inserted in the hot gas line of a window or wall mounted air conditioning system also acts to minimize or eliminate annoying drip of condensate water from the window or wall system. In addition to partially condensing the Freon in the hot gas line of the system the heat contained in the Freon is used, in the auxiliary heat exchanger, to vaporize the condensate water from the evaporator.

In a central air conditioning unit, another technique to recapture a benefit from the condensate is to let the condensate from the evaporator drip onto the condenser coil itself. This may be accomplished by any conventional means, such as by means of a trough around the top of the unit. A small indentation around the bottom of the coil would catch any condensate if the system shuts off so the water can continue to drain and be utilized during the next cycle. The coldest temperature of the condensate water occurs when it drops off the coil and hits the drain pan while its warmest temperature is at the termination point of the drain line, as condensate picks up heat on its journey.

An in any heat exchanger, the leaving fluid [Freon] should exit where the coldest [in this case water] fluid enters. The coldest water hits the top of the coil first and travels down to the bottom by gravity, so the hot gas line should be at the bottom of the condensing coil while the liquid Freon should exit the top of the coil.

The Freon, vaporized by the heat absorbed in evaporator 4 flows through line L3 to compressor 1. The compressed hot vapor exits the compressor 1 via line L1 and flows to condenser 2 where ambient temperature air is forced through the coils of condenser 2 by fan 3, cooling the hot Freon and converting it to liquid form.

Condensate water flows through line L5 to a drain.

Figure 1:
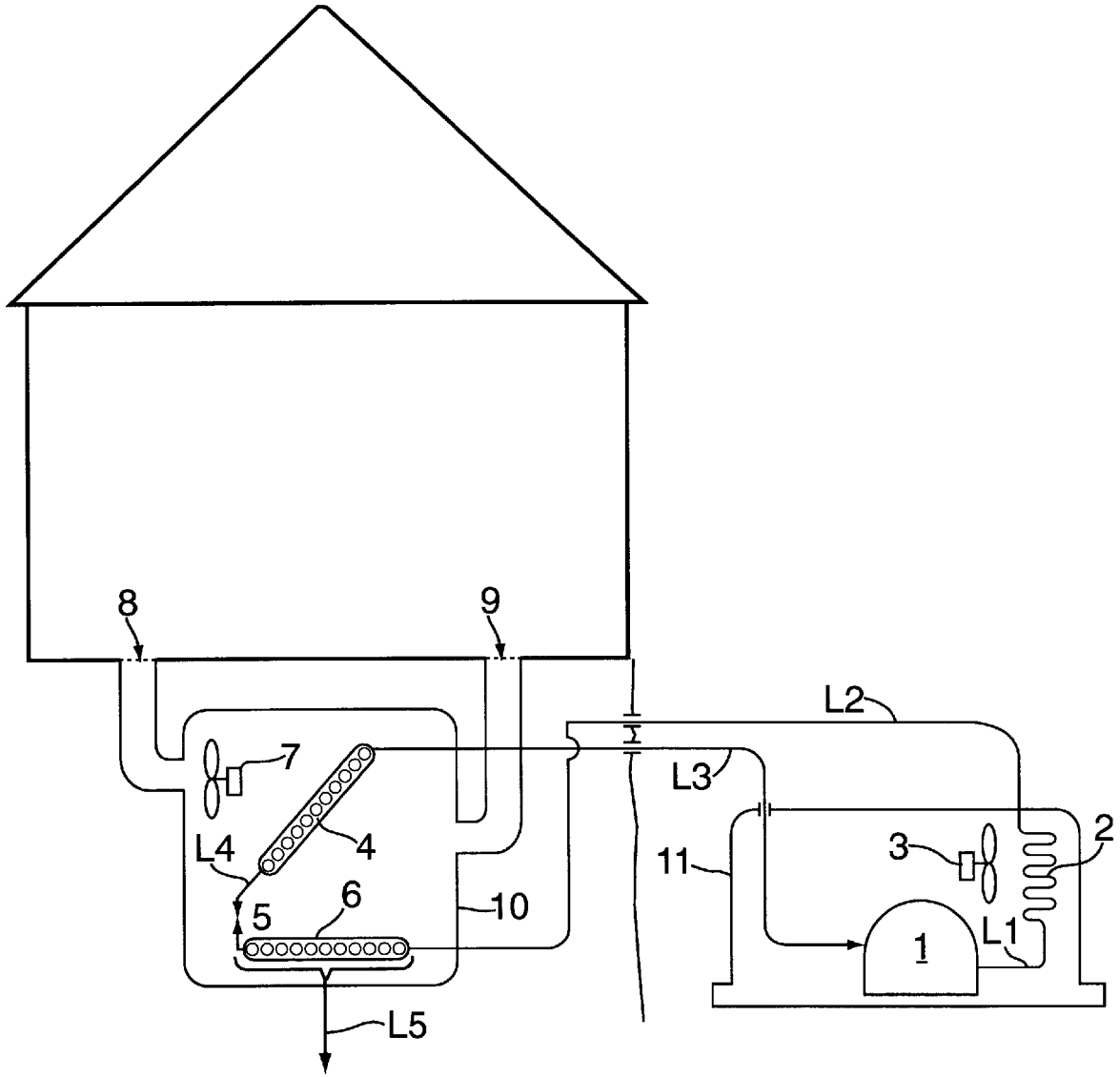
FIG. 1 depicts a high efficiency central air conditioning system embodiment of the invention. A heat exchange fluid, typically Freon is contained in lines L1, L2, L3 and L4. Freon in liquid form at ambient temperature in L2 flows from the condenser 2 to auxiliary heat exchanger 6, positioned such that condensate water dripping off evaporator 4 falls onto its surface. The subcooled Freon exits auxiliary heat exchanger 6 via line L4, passes through expansion device 5 and enters evaporator 4 where hot air to be cooled entering the system through plenum 9 is forced through evaporator 4 by fan 7. The hot air, now cooled by heat exchange in evaporator 4 is returned through plenum 8.
Figure 2:
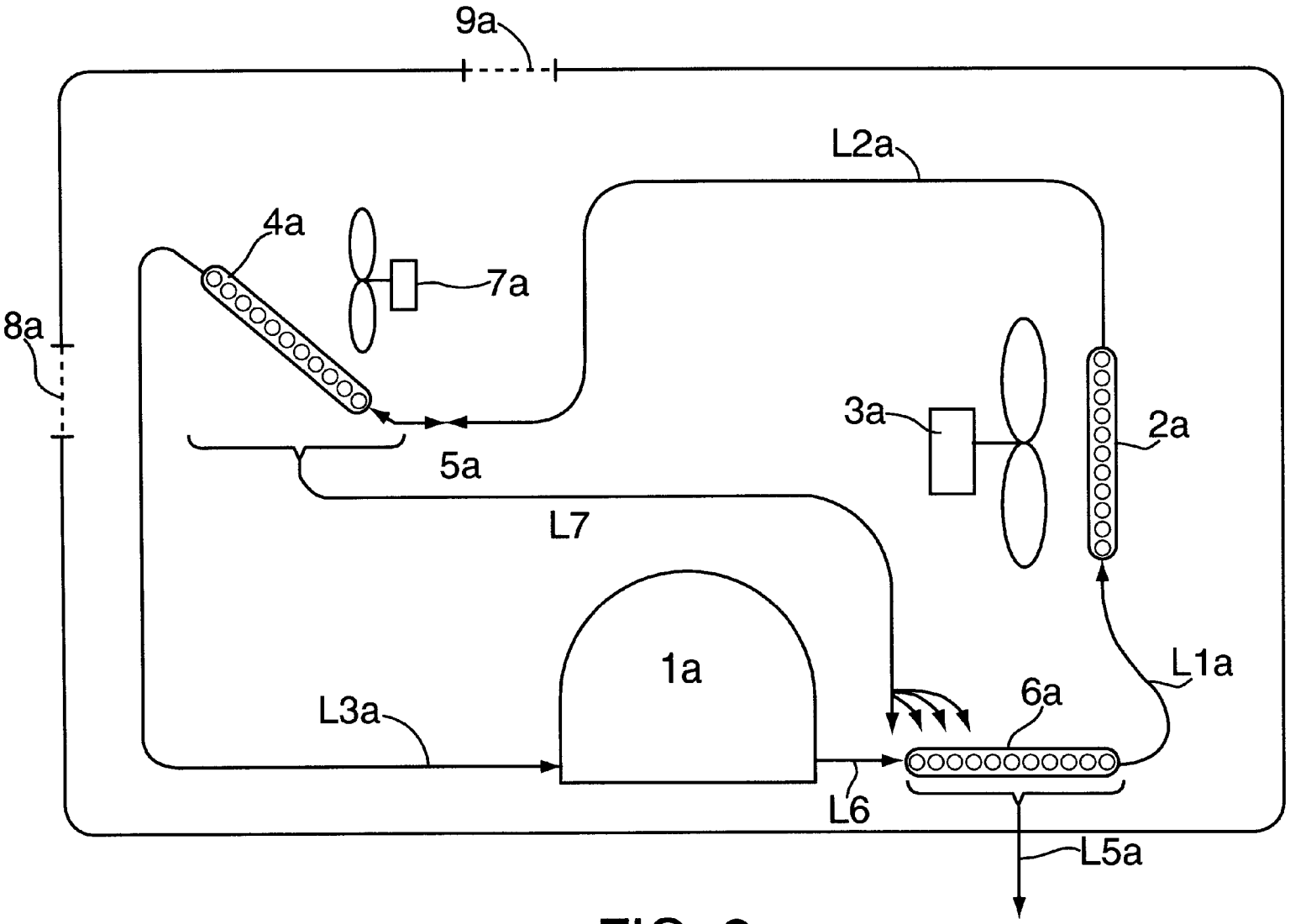

FIG. 2 depicts a window or wall air conditioning system embodiment of the invention. A heat exchange fluid, typically Freon is contained in lines L1*a*, L2*a*, L3*a*, L6 and L7. Freon in liquid form at ambient temperature in L2*a* flows from the condenser 2*a*, passes through expansion device 5*a* and enters evaporator 4*a* where hot air to be cooled entering the system through plenum 9*a* is forced through evaporator 4*a* by fan 7*a*. The hot air, now cooled by heat exchange in evaporator 4*a* is returned through plenum 8*a*.

The Freon, vaporized by the heat absorbed from the air flowing over evaporator 4*a* flows through line L3*a* to compressor 1*a*. The compressed hot vapor exits the compressor 1*a* via line L6 to auxiliary heat exchanger 6*a*, positioned such that condensate water collected from evaporator 4*a* is directed onto its surface using a slinger or other conventional device. The Freon exits auxiliary heat exchanger 6*a* via line L1*a* and flows to condenser 2*a* where ambient temperature air is forced through the coils of condenser 2*a* by fan 3*a*, cooling the hot Freon and converting it to liquid form.

Substantially all the condensate water from evaporator 4*a* vaporizes as it contacts the surface of auxiliary heat exchanger 6*a*. Remaining condensate in liquid form, if any, after heat exchange in auxiliary heat exchanger 6*a*, flows through line L5*a* to a drain.

DETAILED DESCRIPTION

An air conditioning system can be made more efficient by subcooling the liquid Freon below the outdoor temperature by as much as 40° F. on a 90° F. day thereby reducing the amount of flash gas and allowing a much higher percentage of the Freon to be used as effective latent heat. This is beneficial because it will permit the use of less Freon or lower pressure, each of which will result in a more efficient unit.

For example, the typical evaporator operating pressure is 68 psi. This equates to a temperature of about 40° F. if the outdoor temperature is 90°–98° F. which is fairly common in many areas. Flash gas must cool that 90°–98° F. Freon down to 40° F. before any effective heat removal begins. If the Freon is subcooled to 60° F. that would eliminate 30–40° F. worth of flash gas cooling. A reduction in Freon temperature below 60° F. would provide even better results.

Auxiliary heat exchangers useful in the enhanced efficiency air conditioner described herein are characterized by their heat exchange capacity. The heat exchange capacity of suitable heat exchanger depends on the configuration of the heat exchanger, the heat exchange area of the heat exchanger, the fluids being heat exchanged, the materials of construction of the heat exchanger, and the flow rate of the fluids. Different heat exchanger capacities are required for different applications, as it can easily be seen that the heat exchanger requirements of a central whole house air conditioner will be substantially greater than those of a room air conditioner.

The heat exchange capacity of auxiliary heat exchangers useful in this invention range from 400 BTU/hour to as much as or more than 2000 BTU/hour. In general heat exchanger capacities in the range of 600 BTU/hour to 1500 BTU/hour will be satisfactory for most applications.

Whole house central air conditioning systems having a rated capacity of between 2 tons and 5 tons will typically require an auxiliary heat exchanger having a capacity in the range of 1000 BTU/hour to 2000 BTU/hour, most typically between 1250 BTU/hour and 1750 BTU/hour.

Window mounted room air conditioners having a rated capacity of between 5000 BTU and 15,000 BTU will require an auxiliary heat exchanger have a heat exchanger capacity of between 400 BTU/hour and 1000 BTU/hour, most typically between 700 BTU/hour and 900 BTU/hour.

The heat exchange capacity of heat exchangers suitable for preventing dripping from room air conditioners is the same as the capacity of heat exchangers suitable for use for increasing the efficiency of the ac unit.

The heat exchange capacity may be obtained using heat exchangers having a multitude of configurations, such as plate type, coil in air, coil in liquid, coil and fin, etc. Of the many possible configurations I have discovered that coil type heat exchangers with or without fins offer certain unique advantages. Among these advantages are that they exchange heat well, hold pressure well, do not rust and are fabricated utilizing the same construction techniques as standard condenser and evaporator coils.

The heat exchanger the materials of construction may be any material having high heat transference and that does not corrode in the presence of the heat transfer fluids. Copper and aluminum are most useful.

The most important element in maintaining high efficiency is the flow rate of the fluids. To provide the highest efficiency, the coolant fluid, condensate water, must be present and flow over the hot encased Freon is a quantity sufficient to extract a reasonable quantity of heat during the limited period of contact. In instances where no condensate water is present the efficiency of the air conditioner will not be increased as no subcooling will take place. Nor, however, will the efficiency be decreased as there is no energy penalty during the time heat transference is not occurring.

In window units, in instances where an optimum amount of condensate water is present, the combination of factors present will be in equilibrium so that the total quantity of condensate water produced will be evaporated by the heat form the hot Freon line, removing the maximum amount of heat and at the same time removing the condensate water disposal problem.

In sub-optimum conditions, the amount of condensate water will be in excess of that required for subcooling, due to very high humidity levels, in which case some condensate water removal will be required.

A small subcooling coil can be used as an add-on to existing room air conditioning units by placing the coil in a secondary drain unit [preferably constructed of plastic] outside the air conditioning unit, close to the unit so condensate will be as cold as possible. The air conditioning unit is modified, as necessary, to allow condensate to exit immediately rather than pooling in a drain pan. The width and height are preferably approx. ½ to 1" with a snap on top to keep debris out and accessibility for ease of cleaning. Ideally the unit will be fabricated from moldable plastic so it can bend around corners to conform to shape of the ac unit. The outlet can be 3–4" threaded or just an opening large enough for a standard ¾" drain line to be inserted. A newly constructed unit can have its top cover modified to perform the same function without the add-on unit.

A desirable means of extracting heat from the Freon is to use a standard drain pan and a standard cooling coil placed to fit in the drain pan a few inches above the bottom to allow for cleaning. Condensate can then be allowed to drip onto the coil cooling the Freon in it, collect in the drain pan and run into the drain line. Air must not be allowed to flow through the subcooling coil as the air will then become heated. Significantly greater surface area is available for cooling using coils than in a Freon carrying drain pan.

Yet another means of extracting heat from Freon is to use a smaller coil with more passes. A smaller coil takes up less space and can be more efficient as the condensate travels by gravity through a thicker coil, it stays in contact with the coil for a longer period of time, thereby extracting more heat from the Freon than would a single pass larger coil.

Alternatively, the secondary coil may be paced in a small secondary drain pan.

The auxiliary heat exchanger in the liquid Freon line is typically a coil, from about 12 to about 24 feet in length for area air conditioners and from about 24 to about 48 feet in length for central air conditioners. The coil is placed in a drain pan so that condensate water dripping off the evaporator coil encounters the sub-cooling coil and then falls into the drain pan. The exit from the drain pan is located below the bottom of the sub-cooling coil situated in the drain pan such that water which has contacted the coil is immediately removed.

The auxiliary heat exchanger in the hot gas Freon line is typically a coil, from about 12 to about 48 feet in length for area air conditioners. The condensate water dripping off the evaporator coil is routed to the auxiliary heat exchanger and distributed by any convenient means, such as a slinger, baffle or plate with holes, over a substantial portion of the top of the auxiliary heat exchanger. After heat exchange all or a substantial portion of the liquid condensate is vaporized. Any remaining unvaporized condensate water falls into the drain pan. The exit from the drain pan is located below the bottom of the auxiliary heat exchanger situated in the drain pan such that water which has contacted the coil and not vaporized is immediately removed.

My invention is further explained in the following non-limiting examples.

EXAMPLE 1

The effectiveness of an auxiliary heat exchange coil using condensate water to extract heat from and subcool Freon in a central air conditioner was tested. A condenser coil from an old window unit was removed and soldered on the appropriate adapters to fit a central AC unit in the liquid line between the condenser coil and the expansion device. The coil comprised approximately 40 feet of ⅜" OD copper tubing measured 16½"×12"×2" thick and made 3 passes from entrance to exit. The outside temperature was approx. 90° F. The liquid line temperature was 91° F. to 92° F. entering the test coil.

Ice was placed on the coil. The Freon entering the sub-cooling coil averaged 90° F. in and 65° F. out and at times reached a low temperature of 59° F.

The condensate exited at 63° F. The ice used to simulate condensate is 32° F. while actual condensate is 40° F. but since the test coil and drain pans were in the sun on a 90° day during the test procedure some heat was added to at least partially balance the 8° F. temperature difference.

EXAMPLE 2

This Example tests the effect on system pressure of dropping a small amount of condensate water [simulated] on the condenser coil of the air conditioning unit of Example 1. Using 73° F. water sprinkled sparingly on the coil the pressure dropped from 250 psi down to 225 psi. Using 55° F. water the pressure dropped from 250 psi to 215 psi.

EXAMPLE 3

A 6000 BTU window air conditioner unit was turned on when the temperature outside was about 90 degrees F and the relative humidity was about 90. The temperature inside the room was also 90. After allowing the unit to run for 5 minutes, the amount of condensate being produced is measured by collection in a graduated cylinder. Condensate was produced at the rate of approximately 0.2 cup/minute.

EXAMPLE 4

The air conditioner unit of Example 3 is modified by installing a fin and tube type heat exchanger mounted on the inside of the unit housing and connected to the unit by insertion into the hot gas line between the compressor and the condenser. The auxiliary heat exchanger is constructed of 40 feet of ⅜ inch OD copper tubing and positioned such that the condensate water is slung onto the coil using the slinger present in the unit at the rate of 1 oz./minute. After allowing the unit to run for 5 minutes, the condensate that is produced is entirely vaporized and no liquid condensate drips from the unit.

I claim:

1. In a window wall or transom mounted air conditioner comprising a heat exchange fluid, a compressor, a hot gas line connecting the compressor to a condenser, a condenser, a liquid line connecting the condenser to an expansion device, an expansion device, a line connecting the expansion device to an evaporator, an evaporator and a vapor line connecting the evaporator to the compressor, the improvement comprising inserting an auxiliary heat exchanger in the hot gas line between the compressor and the condenser where the sole coolant fluid utilized in the auxiliary heat exchanger is condensate water produced by the evaporator such that condensate water formed during operation of the air conditioner is converted to a substantial extent to the gaseous phase by heat exchange with the hot gas line from the compressor.

2. A dripless window, wall or transom mounted air conditioner comprising a heat exchange fluid, a compressor, a hot gas line connecting the compressor to a condenser, a condenser, a liquid line connecting the condenser to an expansion device, an expansion device, a line connecting the expansion device to an evaporator, an evaporator, a vapor line connecting the evaporator to the compressor, and an auxiliary heat exchanger inserted in the hot gas line between the compressor and the condenser where the sole coolant fluid utilized in the auxiliary heat exchanger is condensate water produced by the evaporator, and the auxiliary heat exchanger is sized such that condensate water formed during operation of the air conditioner is converted to a substantial extent to the gaseous phase by heat exchange with the hot gas line from the compressor.

3. The dripless air conditioner of claim 2 where the auxiliary heat exchanger is sized such that condensate water formed during operation of the air conditioner is essentially completely converted to the gaseous phase by heat exchange with the hot gas line from the compressor.

* * * * *